US006920732B2

(12) United States Patent
Mårtensson

(10) Patent No.: US 6,920,732 B2
(45) Date of Patent: Jul. 26, 2005

(54) FLOORING MATERIAL COMPRISING FLOORING ELEMENTS WHICH ARE ASSEMBLED BY MEANS OF SEPARATE JOINING ELEMENTS

(75) Inventor: Göran Mårtensson, Klagstorp (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 10/802,779

(22) Filed: Mar. 18, 2004

(65) Prior Publication Data

US 2004/0172904 A1 Sep. 9, 2004

Related U.S. Application Data

(62) Division of application No. 09/806,994, filed as application No. PCT/SE99/01699 on Sep. 27, 1999, now Pat. No. 6,763,643.

(30) Foreign Application Priority Data

Oct. 6, 1998 (SE) ..... 9803379

(51) Int. Cl.[7] ..... E04B 2/00

(52) U.S. Cl. ..... 52/586.1; 52/506.06; 52/384

(58) Field of Search ..... 52/582.1, 586.1, 52/585.1, 403.1, 384, 391, 506.05, 509, 343, 506.06; 446/112, 122

(56) References Cited

U.S. PATENT DOCUMENTS

| | | | | |
|---|---|---|---|---|
| 2,863,185 A | | 12/1958 | Riedi | |
| 3,174,411 A | * | 3/1965 | Oestrich et al. | 404/17 |
| 3,676,971 A | * | 7/1972 | Dombroski | 52/603 |
| 3,731,445 A | * | 5/1973 | Hoffmann et al. | 52/391 |
| 4,169,688 A | * | 10/1979 | Toshio | 404/40 |
| 4,304,083 A | | 12/1981 | Anderson | |
| 4,426,820 A | | 1/1984 | Terbrack | |
| 4,599,841 A | | 7/1986 | Haid | |
| 4,599,842 A | | 7/1986 | Counihan | |
| 5,148,850 A | | 9/1992 | Urbanick | |
| 5,950,389 A | | 9/1999 | Porter | |
| 6,763,643 B1 | | 7/2004 | Martensson | |
| 2004/0139678 A1 | | 7/2004 | Pervan | |

FOREIGN PATENT DOCUMENTS

| | | |
|---|---|---|
| DE | 2145024 | 3/1973 |
| DE | 3538538 | 5/1987 |
| DE | 003932980 | 11/1991 |
| DE | 4130115 | 3/1993 |
| DE | 209979 | 5/1999 |
| GB | 2228753 | 9/1990 |
| SE | 82023755 | 10/1983 |
| WO | 9313280 | 7/1993 |
| WO | 9426999 | 11/1994 |
| WO | 9747834 | 12/1997 |

* cited by examiner

*Primary Examiner*—Naoko Slack
(74) *Attorney, Agent, or Firm*—Stevens, Davis, Miller & Mosher, L.L.P.

(57) ABSTRACT

Flooring material comprising board shaped floor elements which are provided with edges, a lower side and a decorative upper surface. The floor elements are intended to be joined by means of separate joining profile. All four edges are provided with one notch-like groove each. The grooves are arrange parallel to its respective edge. The joining profiles are provided with lips arrange in pairs. The lips are intended to each be received by one of the grooves so that the floor elements with the grooves at the adjacent edges will be guided or fixed vertically via the lips of a joining profile. The lips are joined by a middle section of the joining profile. The grooves are furthermore provided with an undercut while the lips are provided with hooks that matches the undercut whereby adjacent floor elements will be guided or fixed horizontally via the undercuts and the hook.

18 Claims, 5 Drawing Sheets

FLOORING MATERIAL COMPRISING FLOORING ELEMENTS WHICH ARE ASSEMBLED BY MEANS OF SEPARATE JOINING ELEMENTS

CROSS-REFERENCE TO RELATED APPLICATIONS

This application is a divisional application of U.S. application Ser. No. 09/806,994 now U.S. Pat. No. 6,763,643, filed May 31, 2001, which is a §371 application of International Application Serial No. PCT/SE99/01699, filed Sep. 27, 1999 the entire disclosures of which are herein incorporated by reference in their entirety.

The present invention relates to a flooring material comprising board shaped flooring elements which are assembled by means of separate joining profiles.

Prefabricated floor boards provided with tongue and groove at the edges are quite common nowadays. These can be installed by the average handy man as they are very easy to install. Such floors can, for example, be constituted of solid wood, fibre board or particle board. These are most often provided with a surface layer such as lacquer, or some kind of laminate. The boards are most often installed by being glued via tongue and groove. The most common types of tongue and groove are however burdened with the disadvantage to form gaps of varying width between the floor boards in cases where the installer hasn't been thorough enough. Dirt will easily collect in such gaps. Moisture will furthermore enter the gaps which will cause the core to expand in cases where it is made of wood, fibre board or particle board, which usually is the case. The expansion will cause the surface layer to rise closest to the edges of the joint which radically reduces the useful life of the floor since the surface layer will be exposed to an exceptional wear. Different types of tensioning devices, forcing the floor boards together during installation can be used to avoid such gaps. This operation is however more or less awkward. It is therefore desirable to achieve a joint which is self-guiding and thereby automatically finds the correct position. Such a joint would also be possible to utilise in floors where no glue is to be used.

Such a joint is known through WO 94/26999 which deals with a system to join two floor boards. The floor boards are provided with a locking device at the rear sides. It is, however, shown in the figures with accompanying description that the floor boards are provided with profiles on the lower side at a first long side and short side. These profiles, which extends outside the floor board itself, is provided with an upwards directed lip which fits into grooves on the lower side of a corresponding floor board. These grooves are arranged on the second short side and long side of this floor board. The floor boards are furthermore provided with a traditional tongue and groove on the edges The intentions are that the profiles shall bend downwards and then to snap back into the groove when assembled. The profiles are integrated with the floor boards through folding or alternatively, through gluing.

The invention according to WO 94/26999 is however burdened with the disadvantage that the profiles are located in a very exposed position and will easily be damaged during handling. According to WO 94/26999, the floor boards may be joined without the lip having to touch the contact surface of the groove at tolerances as small as ±0.2 mm. The profiles are easily deformed during manufacturing, transport and installation of the relatively heavy floor boards since the profiles are located in a very exposed position. Further deformation of the delicate joining profiles is probable since the intentions are that it should be possible to disassemble and reinstall the floor boards according to WO 94/26999. Such deformation will obstruct, and in serious cases even make assembly of the floor boards impossible.

It seems, from WO 94/26999 to be desired to have a clearance between the contact surfaces of the lip and the groove. A tolerance of 0.2 mm is mentioned in the application. The clearance seems to be marked Δ in the figures. Such a clearance will naturally cause undesired gaps between the floor boards. Dirt and moisture can penetrate into these gaps.

Another disadvantage is that the tongue, located on two of the edges, must be tooled from the base material which will loss of the surface layer. Such a surface layer will most often be constituted of thermosetting laminate and is normally the most costly part of a laminate floor. A surface layer of thermosetting laminate will furthermore cause an extensive wear on the tools used for milling.

Another disadvantage becomes clear when performing a life-cycle analysis on the floor boards according to WO 94/26999. According to one preferred embodiment of WO 94/26999, the joining profile is constituted of aluminium. Since it constitutes a part integrated with the floor board it will be practically impossible to recycle the floor board without a very labour-intensive process. The inevitable cutting of the floor board will also be very difficult, utilising common tools, as both aluminium. thermosetting laminate and core will have to be cut at the same time.

It is also known through WO 97/47834 to manufacture a joint where the floor boards are joined so that they are locked together in the horizontal direction. According to this invention a traditional tongue has been provided with heel on the lower side. The heel has a counterpart in a recess in the groove of the opposite side of the floor board. The lower cheek of the groove will be bent away during the assembly and will then snap back when the floor board is in the correct position. The snap-joining parts. in.e. the tongue and groove, is in opposite to the invention according to WO 94/26999 above, where they are constituted by separate parts. seems to be manufactured monolithically from the core of the floor board. WO 97/47834 does also show how the tongue and groove with heels and recesses according to the invention is tooled by means of cutting machining. This invention does also have the disadvantage that the tongue, and particularly, the lower cheek of the groove will easily be damaged during normal handling even though they protrudes less than in the invention according to WO 94/26999 above.

Also WO 97/47834 does have the disadvantage that both tongue and groove will have to be tooled in a way that causes loss of the costly top surface. This tooling will also cause an extensive wear on tools used.

The invention according to WO 97/47834 presumes a certain amount of resilient properties in the core material. The material normally used is not very suitable if a resilient property is desired. MDF (medium density fibre board) or HDF (high density fibre board) should according to WO 97/47834 be suitable as core material. The resilient properties of these materials are however, rather poor, whereby the risk for crack formation, parallel to the top surface, ought to be great.

The invention according to WO 93/13280 deals with a form of clip intended to be used for holding floor boards together. The floor boards are, besides being provided with a traditional tongue and groove, with known disadvantages, also provided with a single groove on the lower side of the floor board. The floor boards rests on the clip whereby a great number of clips will have to be used as the floor otherwise will be resilient. The distance formed between the floor boards and the surface beneath will furthermore cause acoustic resonance. This will give the floor a noisy character and a higher sound level. This is not desired.

The above mentioned problems are solved through the present invention, whereby a floor that endures handling, demands a minimum of machining of the decorative top surface and is easy to install has been achieved. Accordingly, the invention relates to a flooring material comprising board shaped floor elements with a mainly square or rectangular shape. The floor elements are provided with edges, a lower side and a decorative upper surface. The floor elements are intended to be joined by means of separate joining profiles. The invention is characterised in that all four edges of the floor elements are provided with one notch-like groove each. The grooves are arranged parallel to its respective edge. The joining profiles are provided with lips arranged in pairs. The lips are intended to each be received by one of the grooves so that the floor element, with the grooves at the adjacent edges will be guided or fixed vertically via the lips of a joining profile. The lips are joined by a middle section of the joining profile. The grooves are furthermore provided with an undercut while the lips are provided with hooks that matches the undercut. Adjacent floor elements will hereby be guided or fixed horisontally via the undercuts and the hooks. According to one alternative the lips are provided with gripping hooks. Such gripping hooks can be used in grooves without undercut by making them sharp edged.

The grooves are suitably provided with a support for the middle section of the joining profiles. It will thereby be possible to make this embodiment dismountable where it is chosen to install the floor without using glue.

The joining profiles are suitably shaped as extended profiles which suitably are manufactured through extrusion which is a well known and rational method. The joining profiles are suitably shaped as extended lengths or rolls which can be cut to the desired length. The length of the joining profiles considerably exceeds the length of a floor element, before being cut. An advantage with such long profiles is that they can be laid over the whole width of the floor and will thereby reduce the risk for deviations and gaps in the floor since it bridges the lateral joints of the floor. Such bridging of the lateral joints can of course be used even if the joining profiles have the same length as, or is shorter than the floor elements. Shorter pieces of joining profiles is suitably used when it comes to the lateral joints of the floor. The floor elements may alternatively be provided with traditional tongue and groove in the lateral joint edges.

The flooring material comprising the floor elements and joining profiles above is very suited for installations of floors where no glue is needed. It is, of course possible to use glue or double-faced adhesive tape in order to make the installation completely permanent. The glue or tape is then suitably placed on the surfaces of the joining profile located between the lips and/or on the edges of the floor element.

The joining profiles are in the present invention a separate part in opposite to earlier known and cited flooring materials where the joining is made through tongue and groove, profiles or heels. This will give great advantages when handling the floors in connection to manufacturing, transport and installation as traditional joining parts normally are very delicate and sensitive to blows. These parts must, of manufacturing technological reasons, be made of fibre board, particle board or thin aluminium sheets which all are easy to either break or deform. This will normally lead to that the floor elements has to be rejected. Joining profiles according to the present invention can be made of a multitude of materials and by means of many different manufacturing methods. Among the most suitable methods can, however, be mentioned injection moulding for the plus-shaped embodiment of a joining profile and extrusion for the extended embodiment of joining profile. Suitable materials are thermoplastic materials such as poly olefins, polystyrene, polyvinyl chloride or acrylnitril-butadiene-styrene-copolymer. These can suitably be filled with for example wood powder or lime in order to increase the dimension stability as well as increasing the adhesion when being glued.

The invention may also relate to a flooring material comprising board shaped floor elements with a mainly square or rectangular shape. The floor elements are provided with edges, a lower side and a decorative upper surface. The floor elements are joined by means of separate joining profiles. The characterising features in this embodiment are that the floor elements are provided with grooves on at least two opposite sides. The grooves are arranged parallel to its respective edge on the lower side of the floor element. The joining profiles are provided with lips arranged in pairs, which lips are intended to each be received by one of the grooves of the floor elements so that two adjacent floor elements with the grooves at the adjacent edges are guided or fixed horizontally via the lips of a joining profile. The lips are joined by a middle section of the joining profile.

The grooves are placed on a distance from the closest edge of less than half, preferably less than one quarter of the width of the floor element.

The floor elements are suitably provided with grooves on all four edges. The distance between each groove and the closest edge is mainly the same.

The section located between the edges and its closest groove is preferably of thickness which is thinner than the largest thickness of the floor through a recess located on the lower side.

The edges are suitably provided with a vertical guiding by providing a first edge with a preferably V-shaped longitudinal groove with a depth less than 1.8 times, preferably 0.9 times the greatest thickness of the floor. An opposite edge, as related to the first edge, is provided with a matching protruding profile.

The edges are alternatively provided with a vertical guiding by providing two adjacent edges with each a preferably V-shaped longitudinal groove with a depth of less than 1.8 times, preferably less than 0.9 times the greatest thickness of the floor element. The two remaining edges are provided with a protruding profile that matches the longitudinal groove.

The distance between the, in pairs, arranged lips of the joining profile is preferably somewhat smaller than the distance between the grooves placed on each side, and closest to, the joint between two adjacent floor elements. The joining profile will hereby exert a tensioning force on the joint.

The joining profiles are suitably manufactured as extended lengths, through extrusion which is a well-known and rational manufacturing method. The joining profiles are shaped as extended lengths or rolls which can be cut to the desired length. The length of the joining profiles considerably exceeds the length of a floor element. One advantage with such long joining profiles is that they can be laid over the whole width of a floor and will thereby reduce the risk for deviations and gaps in the floor as it bridges the lateral joints in the floor. Such bridging of the lateral joints can of course be used even if the joining profiles have the same length as, or is shorter than the floor elements. Shorter pieces of joining profiles is suitably used when it comes to the lateral joints of the floor. These are suitably installed gradually as every new floor element is added to a row. The floor elements may alternatively be provided with traditional tongue and groove in the lateral joint edges According to one variation of the embodiment above, the joining profiles are intended to be placed in corner where four floor elements meets. The joining profiles is shaped as a plus with four cheeks, as seen from above. The first three cheeks, which together with the fourth forms the plus-shaped joining profile, are provided two lips, arranged in pairs, each. The lips are intended to be placed on each one side of a joint. The fourth cheek is provided with only one lip placed on one side of the joint.

The plus-shaped joining profiles are best suited for installation of square floor elements and will automatically give an excellent guiding of both the lateral and longitudinal joints. These are suitably provided with cheeks that are only somewhat shorter than the half the short side of the floor element. The cheek length is calculated as, from the centre of the joining profile to its outer edge. The plus-shaped joining profiles are also suited for installation of rectangular floor elements in cases where the lateral joints are to coincide. The length of the cheeks are hereby somewhat shorter than half the width of the floor element. Extended profiles can be cut and installed in the intermediate space on the long side between two plus-shaped joining profiles to reinforce the long side joint. In cases where the lateral joints are to be displaced from row to row it is possible to use a T-shaped joining profile which has three cheeks instead of four. This profile is suitably also provided with cheeks of length somewhat shorter than the half the width of the floor element. Flooring materials comprising the floor elements and joining profiles above are very suited where it is desired to install floors without having to use glue. It is of course possible to use glue or double-faced adhesive tape in order to make the installation irreversibly permanent. The glue or the tape is then suitably applied to the surfaces located between the lips, and on the edges.

The joining profiles are, unlike earlier known and herein mentioned flooring materials where the joining is achieved through tongue and groove, profiles or heels, a separate part. This will give great advantages when handling the floors in connection to manufacturing, transport and assembly as the traditional joining parts are very delicate and sensitive to blows. These parts must, of manufacturing technological reasons, be made of fibre board, particle board or thin aluminium sheets which all are easy to either break or deform. This will normally lead to that the floor elements has to be rejected. Joining profiles according to the present invention can be made of a multitude of materials and by means of many different manufacturing methods. Among the most suitable methods can, however, be mentioned injection moulding for the plus-shaped embodiment of a joining profile and extrusion for the extended embodiment of joining profile. Suitable materials are thermoplastic materials such as poly olefins, polystyrene, polyvinyl chloride or acrylnitril-butadiene-styrene-copolymer. These can suitably be filled with for example wood powder or lime in order to increase the dimension stability as well as increasing the adhesion when being glued.

The invention is described further together with enclosed figures showing different embodiments of the invention whereby, FIG. 1 shows, in perspective view, seen from below, an embodiment of a floor element 1 to a flooring material.

FIG. 2*a*-2*c* shows in exploded view and in cross-section different embodiments of a flooring material.

Figure 4:
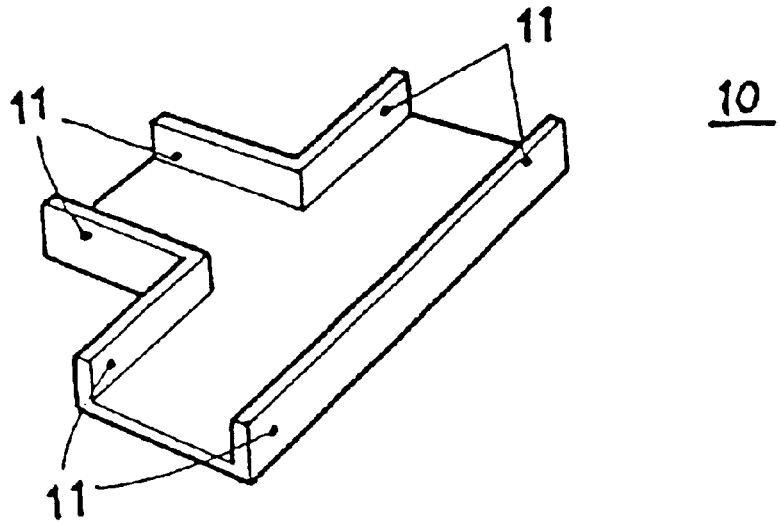
FIG. 4 shows another embodiment of a joining profile 10 to a flooring material.
Figure 6:
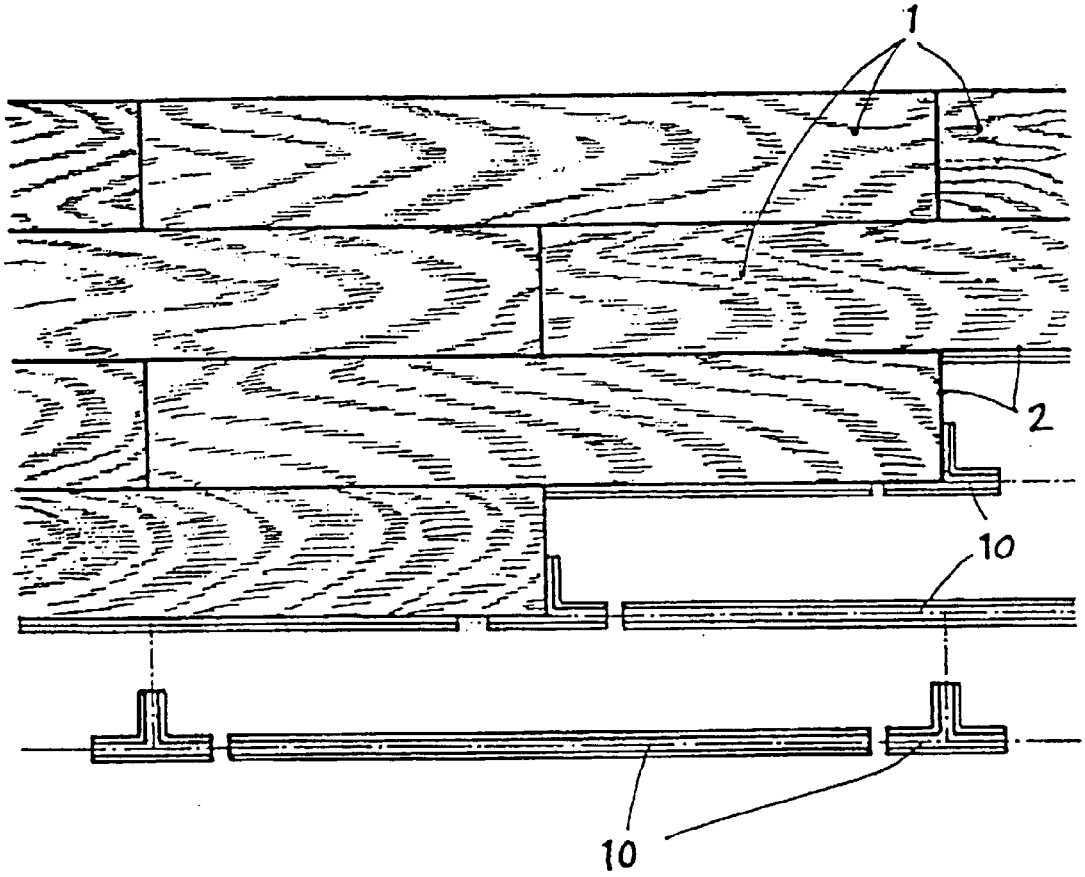

FIG. 6 shows a flooring material according to the invention where rectangular floor elements 1 and T-shaped joining profiles 10, as shown in FIG. 4 and extended joining profiles 10 are used. The floor is only partly installed in order to facilitate understanding of the function.

FIG. 7*a*–*d* shows different preferred embodiments of joints with floor elements 1 which are joined by means of joining profiles 10 via notch-shaped grooves 4 in the edges 2 of the floor boards 1.

Figure 1:
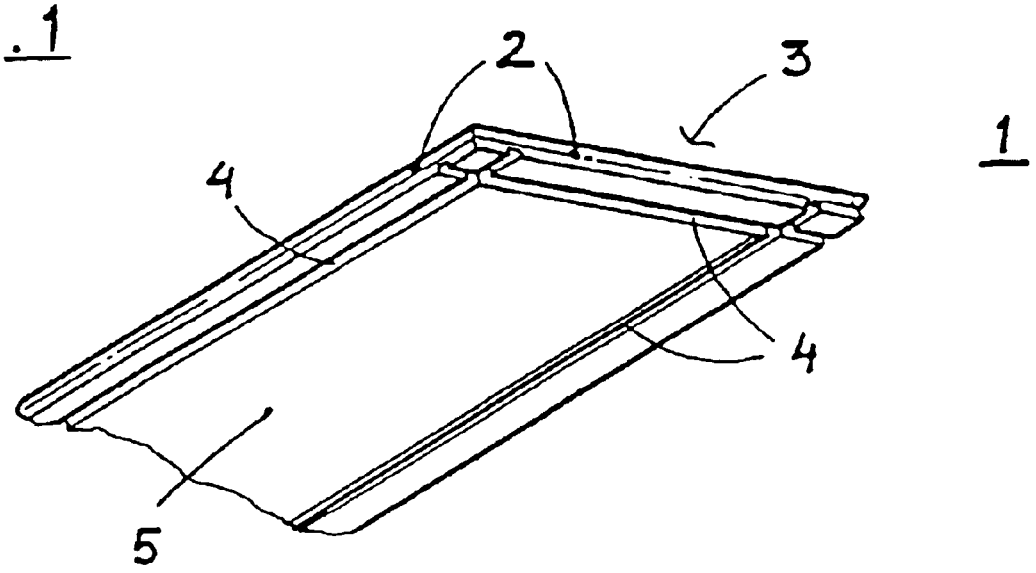
Figure 2A:
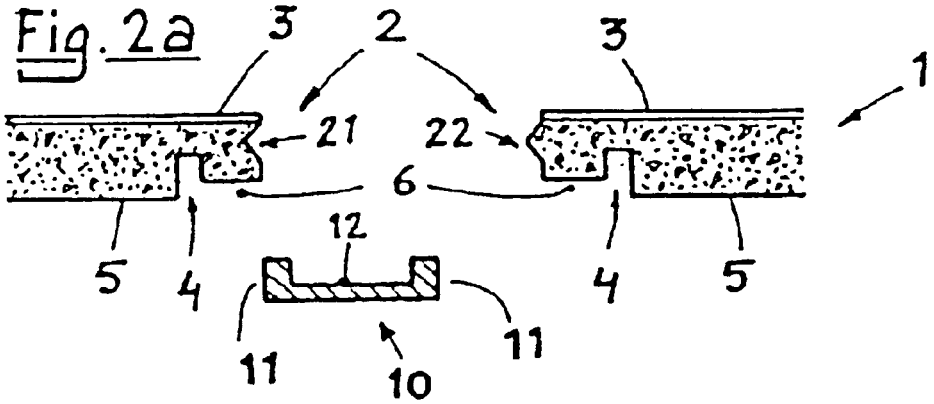
Figure 2B:
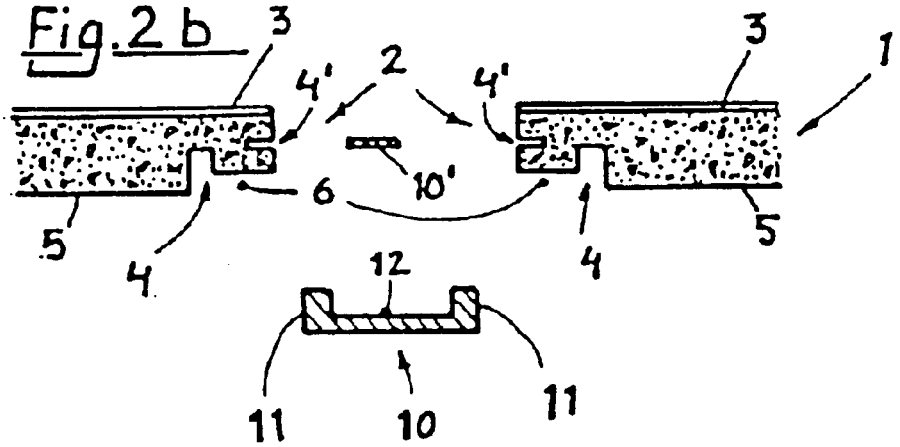
Figure 2C:
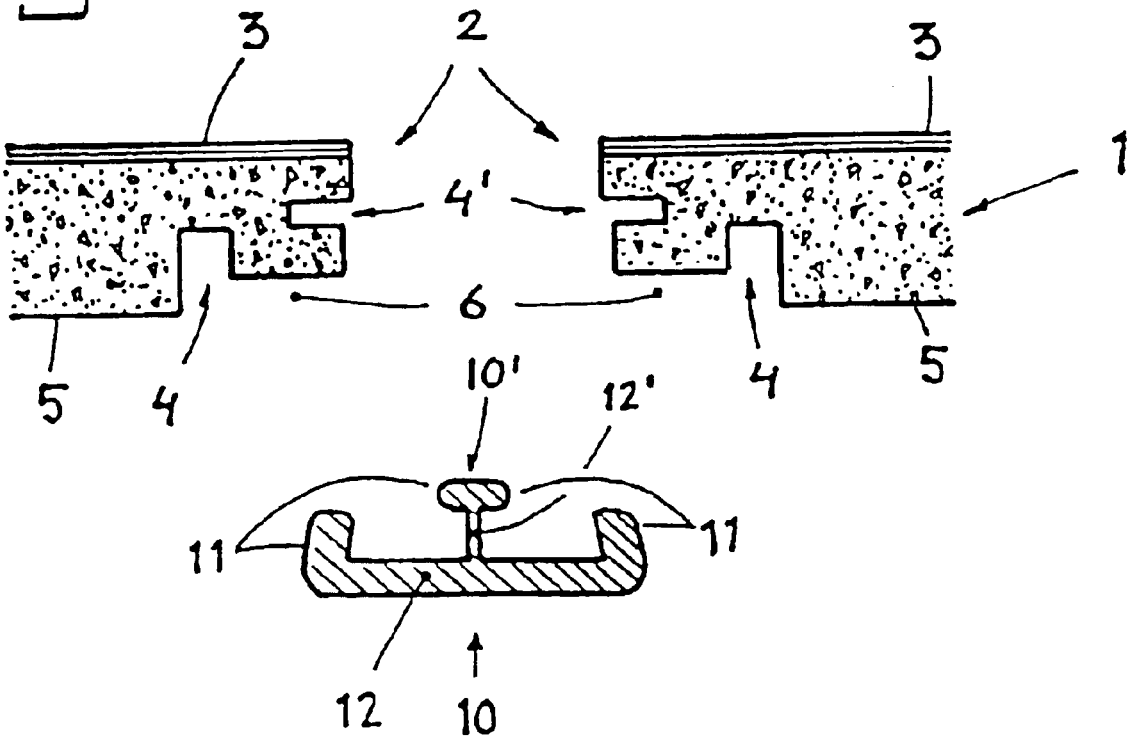

Accordingly, FIG. 1 shows, in perspective seen aslant from below, an embodiment of a floor element 1 to a flooring material. The floor element 1 has rectangular shape and is provided with edges 2, a lower side 5 and a decorative upper surface 3. The floor elements 1 are joined by means of separate joining profiles 10 (FIG. 2-6). The floor element 1 is provided with a groove 4 at each of the edges 2. The grooves 4 are arranged parallel to its respective edge 2. The joining profiles 10 (FIG. 2-6) are provided with lips 11 (FIG. 2-6), arranged in pairs, which each are intended to be received by one of the grooves 4 of the floor element 1. Two adjacent floor elements 1 with the grooves 4 at the adjacent edges 2 are guided or locked horizontally by means of the lips 11 of the joining profile 10. The floor elements 1 most often comprises a core to which an upper decorative layer has been applied. The core most often consists of wood particle or fibre bonded together by glue or resin. It might be advantageous to treat the surface closest to the joint in cases where the floor will be exposed to moisture, since the wood in the core is sensitive to moisture. This surface treatment may suitably include resin, wax or some kind of lacquer. It is not necessary to coat the joint if it is to be glued since the glue itself will protect the core from moisture penetration. The decorative upper surface 3 is constituted by a decorative paper impregnated with melamine-formaldehyde resin. One or more layers of so-called overlay papers made of α-cellulose, impregnated with melamine-formaldehyde resin are possibly placed on top of this. The abrasion resistance can be improved further by sprinkling one or more of the layers with hard particles of for example α-aluminium oxide, silicon carbide or silicon oxide in connection to the impregnation. The lower side 5 may suitably be coated with lacquer or a layer of paper and resin. FIG. 2*a*–2*c* shows in exploded view and in cross-section, different embodiments of a flooring material. The floor elements 1 are provided with edges 2, a lower side 5 and a decorative upper surface 3. The floor elements 1 are joined by means of separate joining profiles 10. The floor elements 1 are at two opposite edges 2 provided with one groove 4 each. The grooves 4 are arranged parallel to its respective edge 2. The grooves 4 are arranged on the lower side 4 at a distance from the closest edge 2 of the less than one fourth of the width of the floor element 1. The section located between the edges 2 and their respective closest groove 4 has a thickness which is smaller than the greatest thickness of the floor board 1 through a recess 6 located on the lower side 5. The thickness of the floor is normally between 5 and 15 mm whereby a suitable difference in thickness at the recess 6 and the main floor thickness is 1–5 mm. The edges 2 are provided with a vertical guiding by a providing a first edge with a V-shaped longitudinal groove 21 (FIG. 2*a*) with a depth less 0.9 times the greatest floor thickness. The opposite edge 2 is provided with a matching profile 22 (FIG. 2*a*). The joining profiles 10 are provided with lips 11 arranged in pairs, which lips each are intended to be received by each one groove 4 of the floor elements 1 so that to adjacent floor elements 1 with the grooves 4 at the adjacent edges 2 are guided or fixed horizontally via the lips 11 of a joining profile 10. The floor elements 1 may, instead of being provided with V-shaped grooves 21 with matching profile 22, alternatively be provided with a notch-like groove 4' (FIG. 2*b*–2*c*) in all four edges 2, which grooves 4' (FIG. 2*b*–2*c*) are intended to receive each one of the lips 11 of a second joining profile 10'. The second joining profile 10' may either be a separate part (FIG. 2*b*) or be joined with the joining profile 10 via a rib 12' (FIG. 2*c*). The lips 11 are connected by a middle section 12 of the joining profile 10. The distance between the, in pairs, arranged lips 11 of the joining profile 10 is somewhat smaller than the distance between the grooves 4 arranged on each one side of, and closest to; the joint between two adjacent floor elements 1. The floor elements 1 will thereby be forced together whereby gaps are avoided. The joining profiles 10 and 10' are manufactured as extended lengths or rolls which may be cut into the desired length during installation. These lengths considerably exceeds the length of the floor elements 1. The embodiments shown in the FIGS. 2*a*–*c* all gives a minimum of machining a minimum of material loss during manufacturing.

Figure 3:
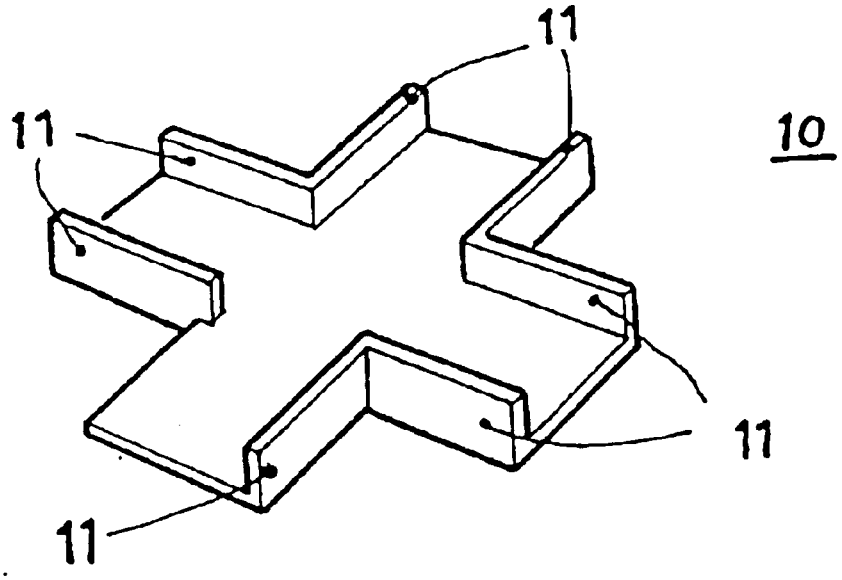
FIG. 3 shows an embodiment of a joining profile 10 to a flooring material.

FIG. 3 shows, in perspective view seen from above, an embodiment of a joining profile 10 to a flooring material. The floor elements 1 are, as shown in FIG. 1, provided with edges 2, a lower side 5 and a decorative upper surface 3. The floor elements 1 are joined by means of separate joining profiles 10. The floor elements 1 are, as shown in FIG. 1, provided with one groove 4 each, at two opposite edges 2. The grooves 4 are arranged parallel to its respective edge 2. The grooves 4 are placed on the lower side 5 at a distance from the closest edge 2 of less than one fourth of the width of the floor element 1. The section located between the edges 2 and their respective closest groove 4 has a thickness which is smaller than the greatest thickness of the floor board 1 through a recess 6 located on the lower side 5. The thickness of the floor is normally between 5 and 15 mm whereby a suitable difference in thickness at the recess 6 and the main floor thickness is 1–5 mm. The edges 2 may, as shown in the FIGS. 2*a*–*c*, be provided with a vertical guiding through a V-shaped groove 21 (FIG. 2*a*) with matching profile 22 (FIG. 2*a*) or by a notch-like grooves 4' (FIG. 2*b*–*c*) in all four edges 2 with a matching second joining profile 10' (FIG. 2*b*–*c*). The plus-shaped joining profile 10 (FIG. 3) is provided with lips 11 arranged in pairs, which lips 11 each are intended to be received by one of the grooves 4 of the floor element 1 so that adjacent floor element 1, with the grooves at the adjacent edges 2 are guided or fixed horizontally via the lips 11 of a joining profile 10. The joining profile is intended to be placed in the corner where four floor elements 1 meet. The joining profile 10 is, as seen from above shaped as a plus with four cheeks, where the first three cheeks, which together with the fourth one forms the plus-shaped joining profile 10, is provided with two lips 11 arranged in pairs each, which are intended to be placed at either side of a joint. The fourth cheek is provided with only one lip 11 arranged on one side of the joint. The reason why the fourth cheek is provided with only one lip 11 is that the last floor element 1 joined with such a joining profile 10 must be slided in from the side in cases where the floor elements 1 are provided with a vertical guiding as shown in the FIGS. 2*a*–*c*. The joining profile 10 as shown in FIG. 3 is used on floors where both longitudinal and lateral joints is to coincide.

FIG. 4 shows in perspective another embodiment of a joining profile 10 to a flooring material. The joining profile 10 corresponds in the main to the one described in connection to FIG. 3. The joining profile 10 showed in FIG. 4 is however provided with only three cheeks and can thereby be described as T-shaped. The joining profile 10 as shown in FIG. 3 is used in floors where only the longitudinal or lateral joints is to coincide.

Figure 5:
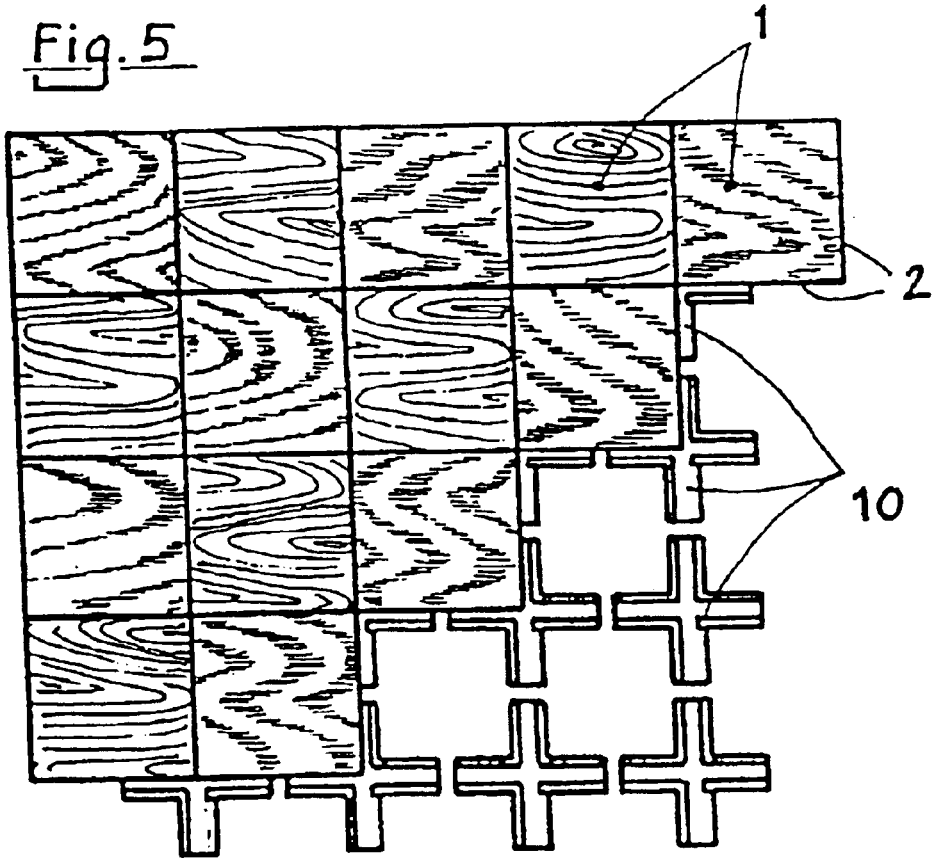
FIG. 5 shows a flooring material according to the invention where square floor elements 1 and plus-shaped joining profiles 10 shown in FIG. 3 is shown. The floor is only partly installed in order to facilitate understanding of the function.

FIGS. 5 and 6 shows a flooring material according to the invention where square and rectangular floor elements 1 respectively and plus-shaped and T-shaped joining profiles 10 respectively as shown in FIGS. 3 and 4 are used. The flooring material is only partly installed in order to facilitate understanding of the function. The plus-shaped profiles are best suited when installing square floor elements 1 and will automatically an excellent guiding of the joints in both longitudinal and lateral direction. These are suitably provided with cheeks being somewhat shorter than half the side of a floor element 1. The length of a cheek is calculated as, from the centre of the joining profile 10 to its outer edge. The plus-shaped joining profiles are also suited for installation of rectangular floor elements 1 in cases where coinciding lateral joints is desired. The length of the cheeks is here somewhat shorter than the short side edge of the floor element 1. Extended profiles 10 can be cut and mounted in the intermediate space between two plus-shaped profiles 10 in order to reinforce the long side joint of the floor board 1.

It is possible to use a T-shaped joining profile which has three cheeks instead of four in cases where a position of the lateral joints shifting from row to row (FIG. 6) is desired. This installation pattern is most often used when installing rectangular floor elements 1. The length of the cheeks is also here, somewhat smaller than half the short side of the floor elements 1. The flooring material comprising the above floor elements 1 and joining profiles 10 are very suited for installations where it is desired to avoid use of glue. It is, of course, possible to use glue or double faced adhesive tape in order to make the installation completely permanent. The glue or tape is then suitably applied to the surfaces of the joining profile 10 that are located between the lips 11 and on the edges 2 (FIG. 2).

It is also possible to use only extended profiles 10 when installing floor elements 1. These are then suitably cut to cover the full width of the floor. The joining profiles 10 will then extend in the same direction as the rectangular floor elements 1. Small pieces are cut from joining profiles 10. These small pieces are placed in the lateral joints as every new floor element 1 is installed. It is suitable to bring these small pieces from below into the joint between two assembled floor boards 1.

Figure 7A:
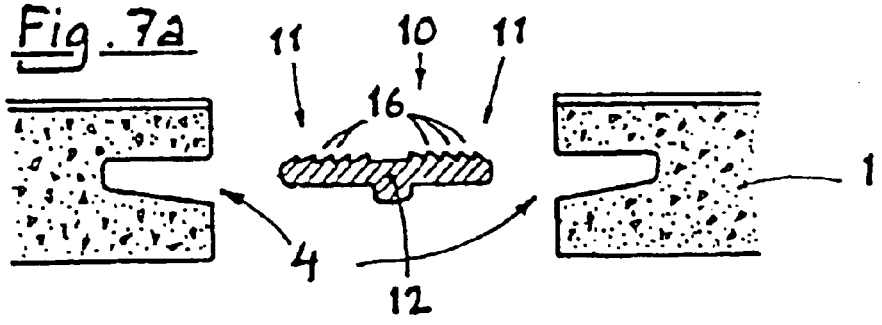
Figure 7B:
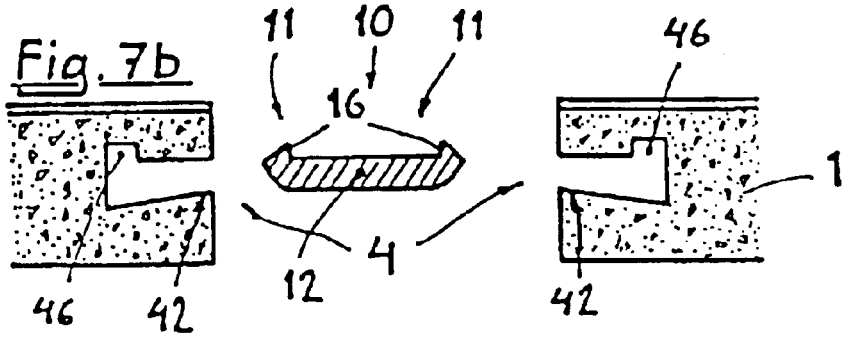
Figure 7C:
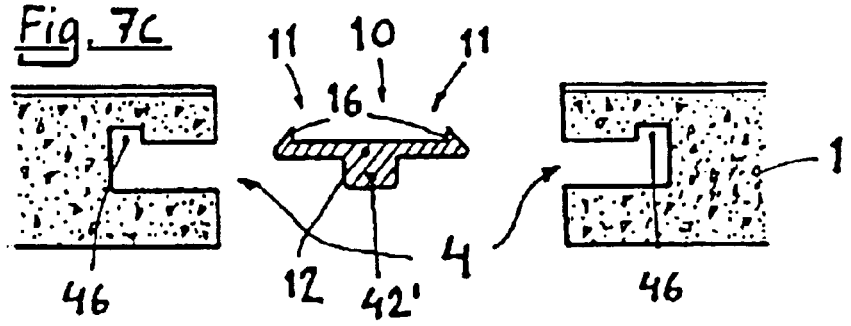
Figure 7D:
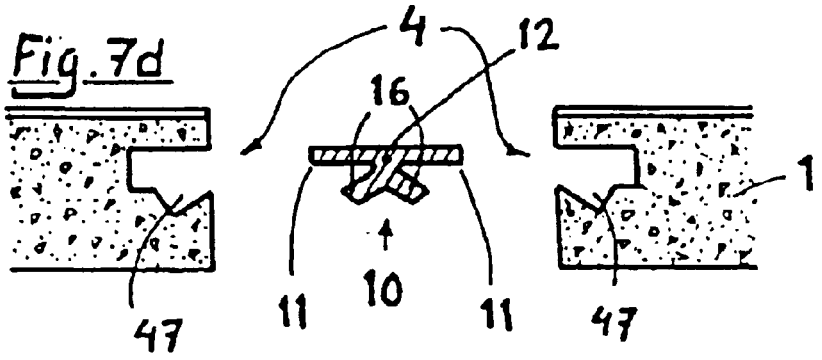

FIG. 7*a*–*d* shows different embodiments of joints with floor elements 1 which are joined by means of joining profiles 10 via grooves 94 in the edges 2 of the floor boards 1. The floor boards 1 are provided with grooves 94 in all four edges 2. The grooves 94 are each intended to receive one of the lips 11 of the joining profile 10. The lips 11 are provided with gripping hooks 16. The floor can be made snap-joinable by providing the grooves 94 with a undercut 46 (FIG. 7*b–c*) and by providing the lips with matching hooks 16 (FIG. 7*b–c*). In order to make the joint dismountable, which can be advantageous even if the floor elements are to be glued, the grooves are provided with a support 42 (FIG. 7*b*) for the middle section 12 of the joining profile 10. The middle section 12 can alternatively be provided with a support 42' (FIG. 7*c*). Such a floor element 1 is then dismounted by lifting it slightly along the free edge 2, whereby the hook will be disengaged from the undercut 46. The simplest way to achieve such undercuts 46 are through broaching or laser cutting. The floor elements 1 may alternatively be joined a more shallow undercut 47 (FIG. 7*d*) which can be achieved with traditional methods such as milling. The embodiments shown in FIG. 7*a–d* do all give a minimum of cutting and lost material during manufacturing. The joining profiles 10 used in the embodiments shown in FIG. 7*a–d* are also manufactured in extended lengths or rolls which are cut to the desired length in connection to the installation of the floor. The joining profiles 10 and/or the floor elements 1 may, of course, be coated with glue or adhesive double-faced tape. The invention is not limited by the embodiments shown since they can be varied in different ways within the scope of the invention.

What is claimed is:

1. Flooring system comprising board shaped floor elements having a mainly square or rectangular shape and each being provided with four side edges, a lower surface and a decorative upper surface, wherein the flooring system further comprises separate joining profiles for connecting said board shaped floor elements to each other, wherein each of the floor elements are provided with grooves which are formed in the lower surface thereof, each groove being positioned in parallel to one of the side edges of the floor elements, the parts of each of the floor elements which are disposed between the side edges and the respective closest grooves are thinned down by means of a recess in the corresponding parts of the lower surface of the floor element, and each joining profile consists of lips arranged in pairs and joined by a middle section, each lip being so arranged and constructed as to be received by one of the grooves of a floor element, wherein each joining profile has the shape of a T with three cheeks, the cheeks of each joining profile each being provided with said lips arranged in pairs and joined by a middle section.

2. Flooring system according to claim 1, wherein each groove is formed at a distance from the closest side edge which is less than ¼ of the width of the respective floor element.

3. Flooring system according to claim 1, wherein the side edges are provided with a V-shaped groove or matching profiles, respectively.

4. Flooring system according to claim 1, wherein said lips extend at an acute angle with respect to said middle section of said joining profile when not joined to said elements.

5. Flooring system according to claim 1, wherein said joining profiles have a length greater than the length of said elements.

6. Flooring system according to claim 1, wherein at least one of said pairs of lips is interrupted.

7. Flooring system comprising board shaped floor elements having a mainly square or rectangular shape and each being provided with four side edges, a lower surface and a decorative upper surface, wherein the flooring system further comprises separate joining profiles for connecting said board shaped floor elements to each other, wherein each of the floor elements are provided with grooves which are formed in the lower surface thereof, each groove being positioned in parallel to one of the side edges of the floor element, the parts of each of the floor elements which are disposed between the side edges and the respective closest grooves are thinned down by means of a recess in the corresponding parts of the lower surface of the floor element, and each joining profile is provided with lips arranged in pairs and joined by a middle section, each lip being so arranged and constructed as to be received by one of the grooves of a floor element, wherein each of the joining profiles has the shape of a +with four cheeks, and three of the cheeks of each of these joining profiles are provided with said lips arranged in pairs and joined by a middle section, whereas the fourth cheek thereof is provided with only one lip and a middle section.

8. Flooring system according to claim 7, wherein each groove is formed at a distance from the closest side edge which is less than ¼ of the width of the respective floor element.

9. Flooring system according to claim 7, wherein the side edges are provided with a V-shaped groove or matching profiles, respectively.

10. Flooring system according to claim 7, wherein the side edges are provided with notch-like grooves, and the system further comprises matching second joining profiles.

11. Flooring system according to claim 10, wherein said second joining profiles are parts of said joining profiles.

12. Flooring system according to claim 10, wherein said second joining profiles are separate parts.

13. Flooring system comprising board shaped floor elements having a mainly square or rectangular shape and each being provided with four side edges, a lower surface and a decorative upper surface, wherein the flooring system further comprises separate joining profiles for connecting said board shaped floor elements to each other, wherein each of the floor elements are provided with grooves which are formed in the lower surface thereof, each groove being positioned in parallel to one of the side edges of the floor elements, the parts of each of the floor elements which are disposed between the side edges and the respective closest grooves are thinned down by means of a recess in the corresponding parts of the lower surface of the floor element, and each joining profile is provided with lips arranged in pairs and joined by a middle section, each lip being so arranged and constructed as to be received by one of the grooves of a floor element, wherein each joining profile has the shape of a T with three cheeks, the cheeks of each joining profile each being provided with said lips arranged in pairs and joined by a middle section wherein at least one side edge comprises a notch, wherein said at least one notch extends substantially parallel to said decorative upper surface, and the system further comprises second joining profiles to fit in said at least one notch.

14. Flooring system according to claim 13, wherein said second joining profiles are parts of said joining profiles.

15. Flooring system according to claim 13, wherein said second joining profiles are separate parts.

16. Flooring system according to claim 13, wherein said second joining profile is sized and shaped to simultaneously engage said notch on adjacent panels.

17. Flooring system according to claim 16, wherein said second joining profile is connected to said joining profile by a rib.

18. Flooring systems according to claim 16, wherein said joining profiles are separate.

* * * * *